US005812089A

United States Patent [19]

Locke

[11] Patent Number: 5,812,089

[45] Date of Patent: Sep. 22, 1998

[54] APPARATUS AND METHOD FOR BEAMFORMING IN A TRIANGULAR GRID PATTERN

[75] Inventor: John Wesley Locke, Tempe, Ariz.

[73] Assignee: Motorola, Inc., Schaumburg, Ill.

[21] Appl. No.: 772,646

[22] Filed: Dec. 23, 1996

[51] Int. Cl.[6] ..... H01Q 3/22

[52] U.S. Cl. ..... 342/373; 342/371

[58] Field of Search ..... 342/373, 368, 342/371, 372

[56] References Cited

U.S. PATENT DOCUMENTS 4,652,879 3/1987 Rudish et al. ..... 342/371

FOREIGN PATENT DOCUMENTS 3342698 6/1985 Germany ..... 342/373

*Primary Examiner*—Gregory C. Issing
*Attorney, Agent, or Firm*—Sherry J. Whitney

[57] ABSTRACT

A network (26) for feeding a planar array of radiating antenna elements using row beamformers (28) and column beamformers (30) is made to project multiple contiguous antenna beams in a triangular pattern (22). The row beamformers (28) couple to the column beamformers (30). Phase shifting networks (46) are interposed between the row beamformers (28) and column beamformers (30) to apply a phase slope that distributes up to 180° of phase shift across alternating rows of row beamformers (28).

18 Claims, 4 Drawing Sheets

-PRIOR ART-

APPARATUS AND METHOD FOR BEAMFORMING IN A TRIANGULAR GRID PATTERN

FIELD OF THE INVENTION

This invention relates in general to the field of antennas, and more particularly, to the field of phased array antennas.

BACKGROUND OF THE INVENTION

Multiple contiguous antenna beams are commonly used in satellite communication systems to provide a desired coverage area. Typically, each individual beam of an array is relatively narrow, while the total angular coverage area of the array is relatively wide. Thus, a large number of contiguous beams is used to provide the total coverage desired.

FIG. 1 shows a prior art rectangular grid pattern of four contiguous beams in sine space. As is conventional, contiguous beams are schematically illustrated as circles which contact neighboring beams at roughly equal antenna gain. FIG. 1 shows a problem with contiguous beams arranged in a rectangular grid pattern. With contiguous beams, an area of reduced coverage is positioned central to sets of four beams. If all of the radiating elements of an antenna which generate a contiguous beam pattern radiate with equal energy, the beams may, for example, contact each other at approximately their −4 dB contour points. In the space central to a four beam set, the gain of each beam is attenuated considerably from the gain where beam contact occurs. If mutual beam contact occurs at −4 dB, then the central area may, for example, be down to about −7.9 dB. To increase overall antenna gain in these areas between contiguous beams in a rectangular pattern, it would be desirable to shift every other row of beams horizontally or vertically by ½ of a beam width to create a triangular grid configuration of beams. With such a triangular configuration, the above-discussed exemplary −7.9 dB areas between beams can be reduced, for example, to −6.0 dB, an improvement of almost 2 dB.

A conventional technique for shifting every other row of beams horizontally has used a cluster of microwave horns. A cluster of microwave horn antennas can form beams which are independent of other beams. The antenna horns can be positioned in a triangular grid pattern to achieve a triangular grid beam pattern. One problem with horn clusters is that, in order to move the beams, the horn reflectors are moved mechanically. Another problem with horn clusters is that the relatively large size of the horns is a limiting factor when they are closely packed in an array or located on a satellite.

A planar phased array is an arrangement where radiating antenna elements lie in the same physical plane. Planar phased array antennas are known to provide more efficient beam steerage than horn type antennas since the beams are steed by RF (radio frequency) phase shifting instead of by mechanically moving the horn reflectors. Planar phased arrays have the added advantage of requiring less volume on the spacecraft than a reflector fed by a cluster of horns. Thus, planar phased arrays have solved some of the problems encountered with horn clusters. Unfortunately, conventional planar phased arrays have been unable to achieve triangular grid beam patterns.

Accordingly, a need exists for a planar phased array antenna that achieves a triangular grid beam pattern.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE DRAWINGS

Preferred embodiments of the present invention generate multiple contiguous antenna beams in a triangular grid pattern. The preferred embodiments provide a phased array antenna apparatus and method for improving antenna coverage over that achieved with a rectangular grid pattern in areas between contiguous beams.

Figure 1:
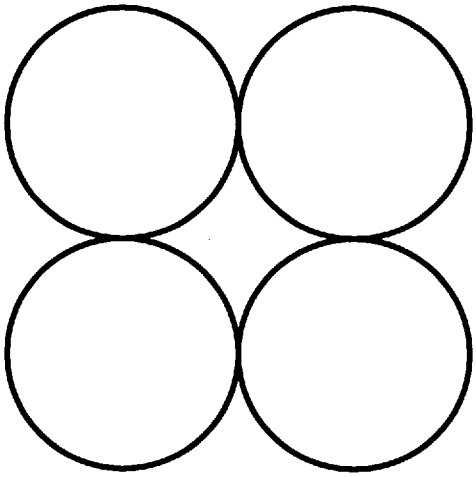
FIG. 1 shows a prior art rectangular grid pattern of four contiguous beams in sine space.
Figure 2:
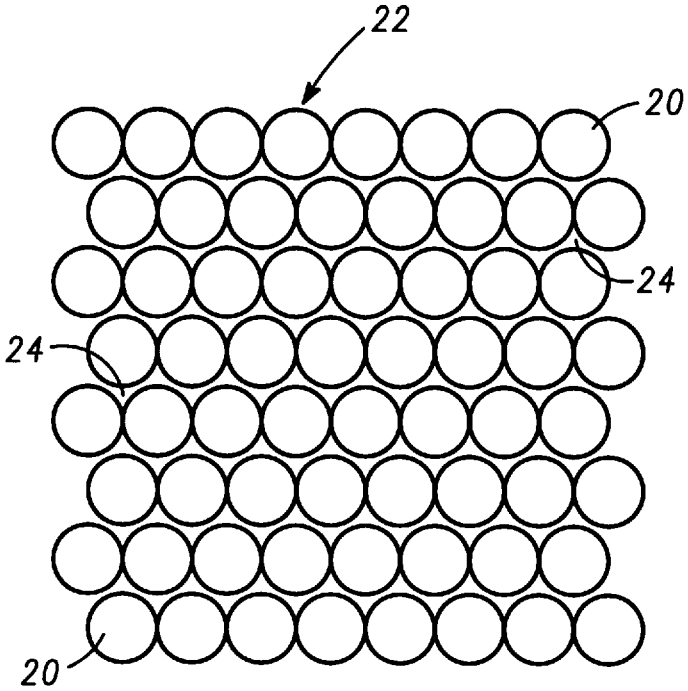
FIG. 2 shows an exemplary eight by eight array of contiguous beams that create a triangular grid pattern in sine space.

FIG. 2 shows a two-dimensional eight by eight array of contiguous beams 20 in sine space forming a triangular grid pattern or array 22. Pattern 22 has the advantage of filling more of reduced coverage areas 24 between beams 20 than the rectangular configuration of contiguous beams (see FIG. 1). As discussed above in the Background, the lowest point of the reduced coverage area is improved from −7.9 dB to −6.0 dB. Pattern 22 is called a triangular grid pattern because, if the centers of all beams 20 in pattern 22 are connected with lines, a pattern of triangles results.

In the following description, the term "row" is taken to mean an alignment along a horizontal or x-axis of a standard Cartesian coordinate system, and "column" means an alignment along a vertical or y-axis of a standard Cartesian coordinate system Those skilled in the art will appreciate that an antenna and its beams may reside in any orientation. The below-presented discussion uses the integer variable "N" to refer to the number of columns in pattern 22 and other patterns (discussed below) and the integer variable "M" to refer to the number of rows in pattern 22 and other patterns (discussed below). Thus, the exemplary embodiment of contiguous beams 20 illustrated in FIG. 2 has N columns, where N equals eight, and M rows, where M also equals eight, of beams 20. Since pattern 22 is a triangular grid pattern, every other row (or column) of beams 20 is shifted one-half of a beam width relative to a rectangular grid pattern, as illustrated in FIG. 1.

Figure 3:
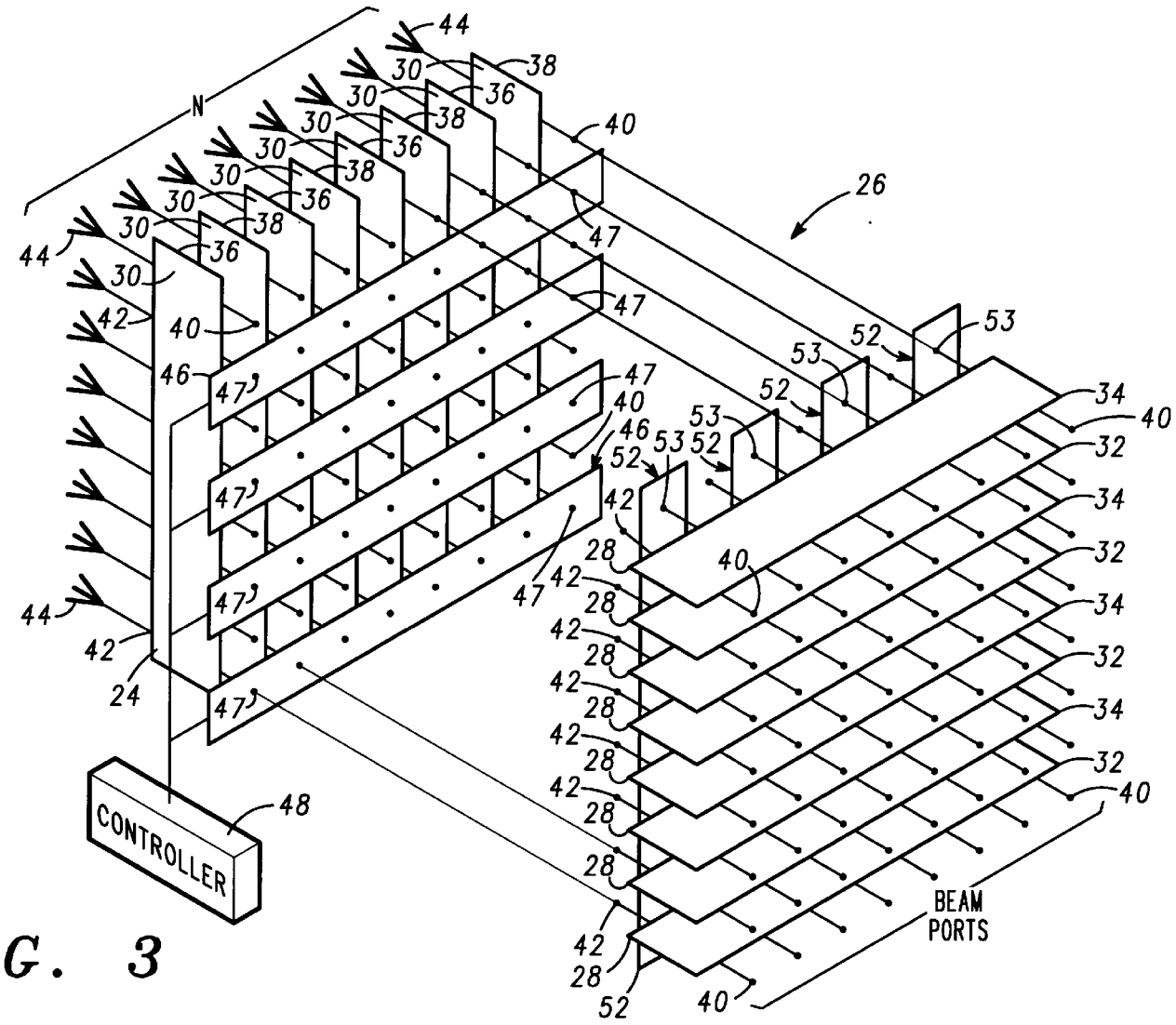
FIG. 3 shows an exploded combining network for feeding an exemplary sixty-four element antenna array of eight columns and eight rows in accordance with a first embodiment of the present invention.

FIG. 3 shows an exploded combining network 26 for feeding an exemplary sixty-four element array of eight columns and eight rows. Network 26 generates pattern 22 (see FIG. 2) and may serve a dual function for both transmitting and receiving. While network 26 and pattern 22 depict eight by eight geometries for clarity, those skilled in the art will appreciate that the present invention may be adapted to any size contiguous antenna beam pattern Network 26 includes a set of row beamformers 28 and a set of column beamformers 30. The set of row beamformers 28 includes odd row beamformers 32 interleaved with even row beamformers 34. The set of column beamformers 30 includes odd column beamformers 36 interleaved with even column beamformers 38. Each of beamformers 28 and 30 represents a one-dimensional beamformer having eight beam ports 40 and eight element ports 42. For each beamformer 28 and 30, beam ports 40 face beam processing circuits (not shown). The beam processing circuits may, for example, include independent transmitters and receivers. For each beamformer 36 and 38, element ports 42 face antenna radiating elements 44. The one-dimensional beamformers 28 and 30 couple together in network 26 to form a two-dimensional beamformer.

FIG. 3 illustrates row beamformers 28 as being exploded away from column beamformers 30 for viewing Beam ports 40 of each column beamformer 30 couple to elements ports 42 from all row beamformers 28 in a one to one correspondence. Each row beamformer 28 has N element ports 42 and N beam ports 40. Each row beamformer 28 couples to all column beamformers 30, and each column beamformer 30 couples to all row beamformers 28. Each column beamformer 30 has M element ports 42 and M beam ports 40. Each element port 42 of each column beamformer 30 couples to a corresponding radiating element 44. Radiating elements 44 are the components at which electromagnetic energy is radiated from and received at network 26. Element ports 42 of row beamformers 28 couple to radiating elements 44 through column beamformers 30, and beam ports 40 of column beamformers 30 couple to the beam processing circuits through row beamformers 28.

In general, each column beamformer 30 forms fan-shaped beams relative to its corresponding radiating elements 44. The fan-shaped beams are relatively narrow in the plane of the columns. Thus, each of the N column beamformers 30 forms M completely overlapping fan-shaped beams. Row beamformers 28 then transform the fan-shaped beams into coherently formed pencil beams which are relatively narrow in the planes of the columns and in the planes of the rows. Thus, N column beamformers 30 and M row beamformers 28 form M*N pencil beams.

In the embodiment of network 26 illustrated in FIG. 3, not all of element ports 42 of row beamformers 28 couple directly to beam ports 40 of column beamformers 30. Network 26 additionally includes M/2 row phase shifting networks 46. Each row phase shifting network 46 is configured to implement a 180 degree phase slope or tilt distributed across a row of beam ports 40 of column beamformers 30. Each row phase shifting networks 46 has N ports 47 coupled to the beam ports 40 of either even row beamformers 34 or to odd row beamformers 32, but not both. Row phase shifting networks 46 implement 180 degree phase slopes across their respective N phase shifting network ports 47.

In particular, a phase delay Øj, measured in degrees, is applied to each beam port 40 in every even or odd row of beam ports 40 of column beamformers 30 according to the formula Øj=180* j/N, where j is the column number and N is the total number of columns in the array. As an example, in the eight by eight array as shown in FIG. 3, N is eight and j varies from one to eight.

In addition, row phase shifting networks 46 couple to a controller 48. Controller 48 applies a control signal which selectively activates and deactivates the application of the phase slope. When the phase slope is applied, triangular grid beam pattern 22 (see FIG. 2) is generated by network 26. When the phase slope is not applied, a rectangular grid beam pattern (see FIG. 1) is generated by network 26. Controller 48 may control the timing of the applied phase slope as well as the manner in which the phase slope is distributed across the subject beam ports 40. Thus, controller 48 switches grid beam patterns, which is an optional but desirable feature of the present invention because it adds flexibility to beam pattern coverage.

Figure 4:
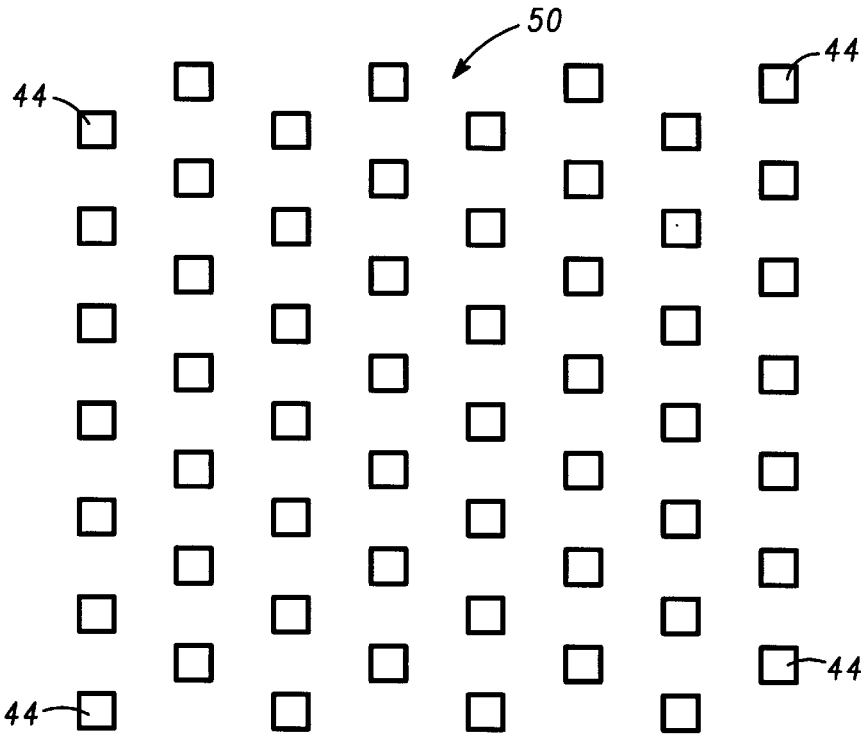
FIG. 4 shows a triangular pattern of radiating elements in a planar antenna array.

FIG. 4 shows a triangular pattern of radiating elements 44 in a planar antenna array 50. Every other column of radiating elements 44 in array 50 is shifted vertically by ½ an element spacing distance. In the preferred embodiments, elements 44 are arranged in a triangular grid pattern to allow greater spacing between elements so that fewer elements (and amplifiers) are needed to fill the desired area of the antenna array 50. However, this is not a requirement of the present invention.

The shifting of every other column of radiating elements 44 in planar phased array antenna 50 does not create triangular grid pattern 22 of beams 20 (see FIG. 2). Rather, a triangular pattern of antenna radiating elements 44, such as shown in FIG. 4, produces a rectangular grid pattern of contiguous beams unless phase shifting networks 46 are included. However, additional phase compensation must be included in network 26 to permit the arrangement of elements 44 in the triangular grid pattern illustrated in FIG. 4.

In particular, this additional phase compensation is supplied by N/2 column phase shifting networks 52. Each column phase shifting network 52 is configured to implement a 180 degree phase slope distributed across a column of element ports 25 of row beamformers 28. Column phase shifting networks 52 have M ports 53 that couple to each of M beam ports 40 from one of N beamformers 30. Column phase shifting networks 52 couple to the element ports 42 which couple to either the even column beamformers 38 or to the odd column beamformers 36, but not both.

In particular, a phase delay $Ø_i$, measured in degrees, is applied to each element port 42 in every even or odd column of element ports 42 of row beamformers 28 according to the formula $Ø_i$=180* i/M where i is the row number and M is the total number of rows in the array. As an example, in the eight by eight array as shown in FIG. 3, M is eight and i varies from one to eight.

Figure 5:
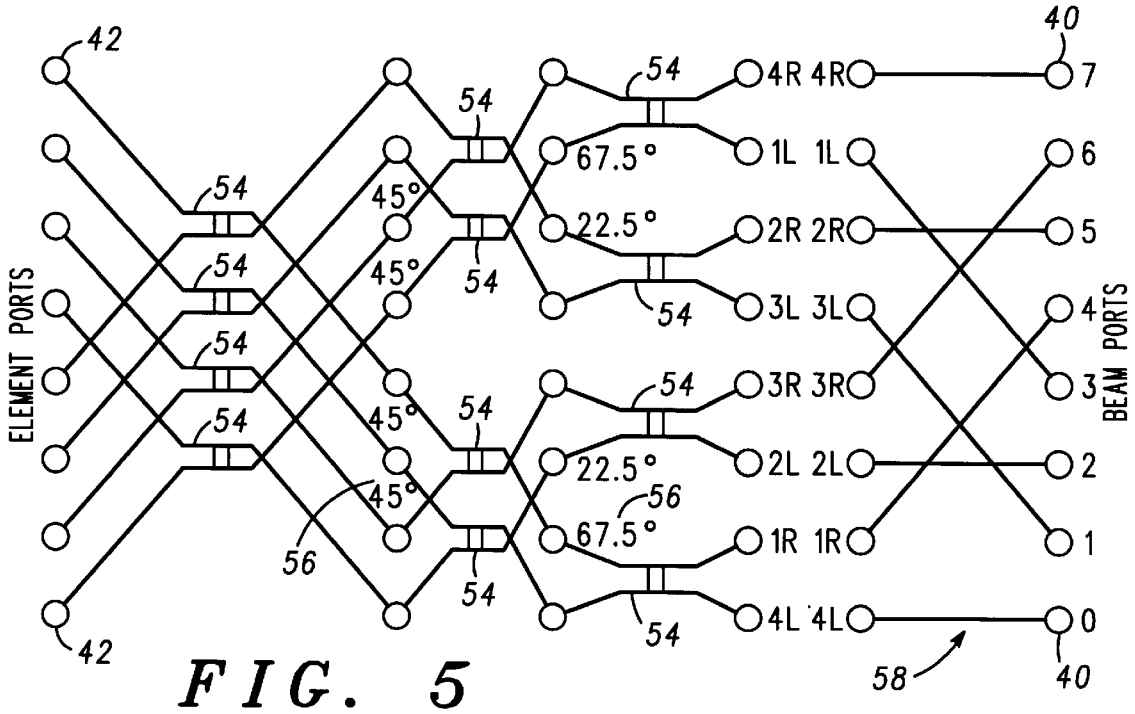
FIG. 5 shows a diagram of a Butler-matrix beamformer.

FIG. 5 shows a diagram of a one-dimensional Butler-matrix beamformer which can serve as any of row beamformers 28 or column beamforms 30 in the embodiment depicted in FIG. 3. In other words, in this embodiment row beamformers 28 are identical to each other and to column beamformers 30.

Each of Butler-matrix beamformers 28 and 30 includes twelve hybrid couplers 54 in the eight element port 42 and eight beam port 40 example depicted in FIG. 5. Each hybrid coupler 54 acts as a signal summer/splitter, and also adds 90 degrees of phase delay to any signal component which crosses the coupler diagonally. The preferred embodiment of the present invention also includes at least eight phase shifters 56 for the eight element port 42 and eight beam port 40 example. Phase shifters 56 insert conventional amounts of phase delay along internal signal paths within Butler-matrix beamformers 28 and 30, as shown in ellipses in FIG. 5.

Butler-matrix beamformers 28 and 30 optionally include a reordering network 58. Reordering network 58 provides beam ports 40 in a spatial order. Those skilled in art will appreciate that a natural order of signals emerging from a Butler-matrix at beam ports need not match the spatial ordering of signals at element ports. Accordingly, reordering network 58 restores the spatial ordering of beam ports 40 to match the ordering of element ports 42. The above-discussed phase slopes are distributed across spatially ordered ports. However, naturally ordered ports may be used by adjusting the phase slopes.

The preferred embodiments of this invention use Butler-matrix beamformers for row beamformers 28 and column beamformers 30. However, those skilled in the art will appreciate that other beamforming techniques will work as well. Those skilled in the art understand that a multi-beam beamformer may comprise any beamformer which forms multiple orthogonal beams, including for example, a Butler-matrix beamformer (as described above), a Digital-Fast-Fourier-Transform (DFFT) and/or a Rotman lens.

Figure 6:
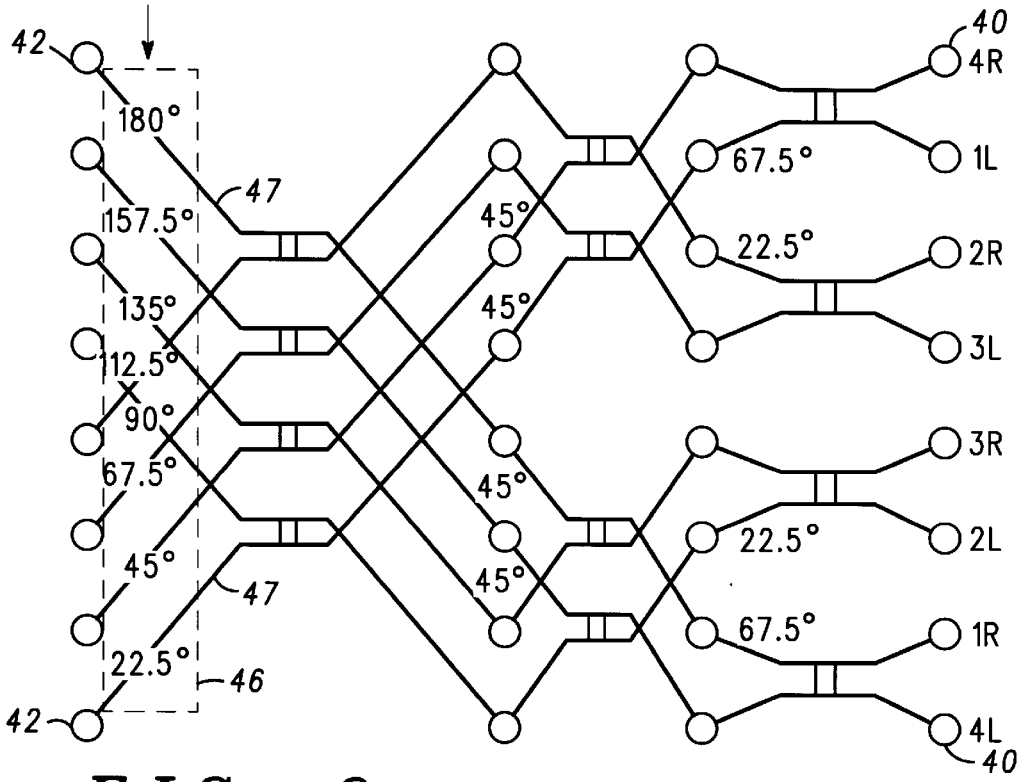
FIG. 6 shows a single odd row beamformer with a 180 degree phase slope distributed across its element ports in accordance with a second embodiment of the present invention.
Figure 7:
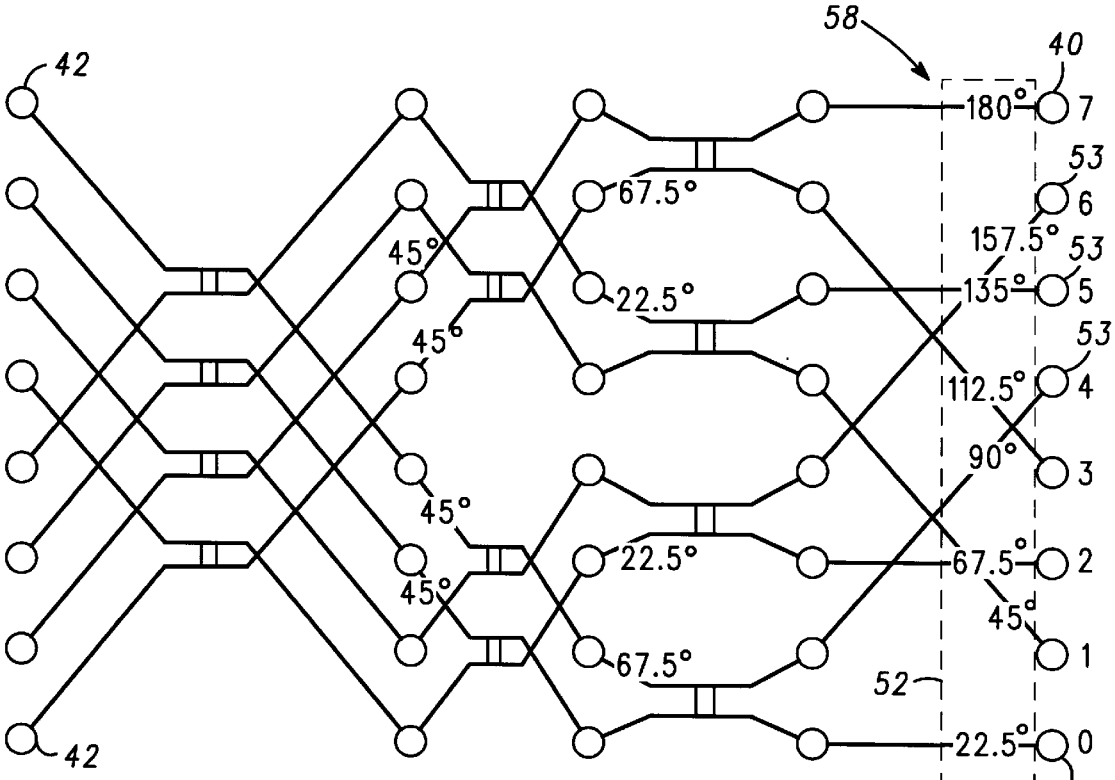
FIG. 7 shows a single even column beamformer with a 180 degree phase slope distributed across its beam ports in accordance with the second embodiment of the present invention.

FIGS. 6 and 7 depict a second embodiment of the present invention. FIG. 6 shows a single odd row beamformer 32 with a 180 degree phase slope distributed across its element ports 42, and FIG. 7 shows a single even column beamformer 38 with a 180 degree phase slope distributed across its beam ports 40. The second embodiment depicted in FIGS. 6 and 7 differs from the embodiment depicted in FIG. 3 in that phase shifter networks 52 are incorporated in even column beamformers 38 and that phase shifter networks 46 are incorporated in odd row beamformers 32. Accordingly, in this second embodiment phase shifter networks 46 and 52 are not separate components external to beamformers 28 and 30 as depicted in FIG. 3.

FIG. 6 shows that phase shifting network 46 is included within each odd row beamformer 32 for an exemplary eight element port 42 and eight beam port 40 beamformer. FIG. 6 also depicts odd row beamformers 32 without optional reordering network 58 (see FIG. 5). As discussed above, network 46 is desirably tunable so that the phase slope generated thereby can be switched on and off to switch pattern 22 between a triangular grid pattern of beams and a rectangular grid pattern of beams. Moreover, network 46 implements a phase slope in accordance with the formula $Ø_j$=180* j/N, discussed above. While the above-presented discussion indicates that phase shifting network 46 is applied to odd row beamformers 32, this is not a requirement. Phase shifting networks 46 need only be applied to alternating rows of beamformers 28.

FIG. 7 shows that phase shifting network 52 is included within each of even column beamformers 38 for an exemplary eight element port 42 and eight beam port 40 beamformer. Optional reordering network 58 is included in FIG. 7, and the phase slope generated by network 52 is applied across the reordered arrangement of beam ports 40. Network 52 implements a phase slope in accordance with the formula Øi=180* i/M discussed above. While the above-presented discussion indicates that phase shifting network 52 is applied to even column beamformers 38, this is not a requirement. Phase shifting networks 52 need only be applied to those beamformers 30 which are attached to the columns of elements that were shifted up or down in order to create the triangular grid.

In summary, the present invention provides an apparatus and method for the generation of multiple contiguous antenna beams in a triangular grid pattern using a planar phased array antenna. The ability to form triangular patterns of beams provides improved coverage in the area between contiguous beams compared to rectangular grid beam patterns. The present invention produces a triangular grid pattern of beams in a planar phased antenna array by injecting a 180 degree phase slope across alternating rows of row beamformers. In addition, this phase slope may be selectively activated and inactivated to switch between rectangular and triangular grid beam patterns.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A phased array antenna for formation of multiple contiguous antenna beams in a triangular grid pattern, said antenna comprising:

a number of antenna elements, said number being equal to the product of M and N, where M and N are integer numbers;

N one-dimensional beamformers wherein each of said N beamformers has M element ports coupled to M of said antenna elements and each of said N beamformers has M beam ports; and a phase shifting network having N ports, wherein each of said N phase shifting network ports couples to one of said M beam ports from one of said N beamformers and said phase shifting network is configured to implement a phase slope across said N phase shifting network ports.

2. An antenna as claimed in claim 1 wherein:

said phase shifting network is a first phase shifting network;

each of said N phase shifting network ports couples to a first one of said M beam ports; and said antenna additionally comprises a second phase shifting network having N ports, wherein each of said N second phase shifting network ports couples to a second one of said M beam ports from one of said N beamformers, and said second phase shifting network is configured to implement a phase slope across said N second phase shifting network ports.

3. An antenna as claimed in claim 1 wherein:

said phase shifting network is a first phase shifting network;

said antenna comprises M/2-1 phase shifting networks in addition to said first phase shifting network; and each of said M/2-1 phase shifting networks has N ports, wherein each of said N phase shifting network ports of each of said M/2-1 phase shifting networks couples to corresponding ones of said M beam ports from one of said N beamformers and said M/2-1 phase shifting networks are each configured to implement a phase slope across their respective N phase shifting network ports.

4. An antenna as claimed in claim 3 wherein said first and said M/2-1 phase shifting networks implement substantially equivalent phase slopes across their respective N phase shifting network ports.

5. An antenna as claimed in claim 4 wherein each of said first and said M/2-1 phase shifting networks implements a phase slope that slopes to approximately 180 degrees.

6. An antenna as claimed in claim 4 wherein:

said M beam ports from said N beamformers are spatially ordered; and said first and said M/2-1 phase shifting networks couple to alternating ones of said M beam ports from said N beamformers.

7. An antenna as claimed in claim 1 wherein:

said beamformers are column beamformers; and said antenna additionally comprises M row beamformers each having N element ports, each row beamformer element port being coupled to one of said column beamformer, beam ports and said phase shifting network ports.

8. An antenna as claimed in claim 7 wherein:

said row beamformer element ports on M/2 alternating ones of said row beamformers couple to said column beamformer beam ports.

9. An antenna as claimed in claim 1 wherein:

said antenna elements are positioned in a triangular grid pattern;

said phase shifting network is a first phase shifting network;

said antenna additionally comprises a second phase shifting network having M ports, wherein each of said M second phase shifting network ports couples to each of said M beam ports from one of said N beamformers; and said second phase shifting network is configured to implement a phase slope across said M second phase shifting network ports.

10. An antenna as claimed in claim 1 wherein:

said antenna elements are positioned in a triangular grid pattern;

said phase shifting network is a first phase shifting network;

said antenna additionally comprises N/2 additional phase shifting networks, each of which has M ports, wherein said M phase shifting network ports of said N/2 additional phase shifting networks respectively couple to M beam ports from alternating ones of said N column beamformers;

said N/2 additional phase shifting networks are configured to implement phase slopes across their respective phase shifting network ports; and each of said N/2 additional phase shifting networks implements one of said phase slopes to approximately 180 degrees.

11. An antenna as claimed in claim 1 wherein said phase shifting network comprises N tunable phase shifters, said N tunable phase shifters being configured to selectively apply and remove said phase slope so that said antenna beams are selectively shifted between said triangular grid pattern and a rectangular grid pattern.

12. In connection with a planar phased array antenna having M row beamformers which communicate signals with N column beamformers where M and N are integer numbers, a method of forming multiple contiguous antenna beams in a triangular grid pattern comprising the steps of:

coupling said column beamformers, to a planar array of N times M antenna elements; and inserting M/2 phase slopes along M/2 of said row beamformers respectively, between said row, and column, beamformers.

13. A method as claimed in claim 12 wherein said M/2 phase slopes are substantially identical to one another.

14. A method as claimed in claim 13 wherein:

said method additionally comprises the step of spatially ordering said signals communicated between said N column beamformers, and said M row beamformers; and said inserting step inserts said M/2 phase slopes along alternating ones of said row beamformers.

15. A method as claimed in claim 12 wherein:

said inserting step inserts said M/2 phase slopes using N tunable phase shifters for each of said M/2 phase slopes; and said method additionally comprises the step of selectively applying and removing said M/2 phase slopes so that said antenna beams are selectively shifted between said triangular grid pattern and a rectangular grid pattern.

16. A method as claimed in claim 12 additionally comprising the steps of:

arranging said N times M antenna elements in a triangular grid pattern; and inserting N/2 element-compensating phase slopes along N/2 of said column beamformers, respectively, said element-compensating phase slopes being inserted between said row, and column beamformers.

17. A planar phased array antenna for formation of multiple contiguous antenna beams in a triangular grid pattern, said antenna comprising:

a number of antenna elements, said number being equal to the product of M rows and N columns, where M and N are integer numbers;

N one dimensional column beamformers, wherein each of said N column beamformers has M element ports coupled to M of said antenna elements, and each of said N column beamformers has M beam ports;

M one dimensional row beamformers, wherein each of said M row beamformers, has N element ports, and for each of M/2 of said M row beamformers, said N element ports couple to one of said M beam ports of each of said N column beamformers; M/2 phase shifting networks each of which has N column ports and N row ports, wherein said N row ports of each phase shifting network respectively couple to said N element ports of said M row beamformers, and said N column ports of each phase shifting network respectively couple to one of said M beam ports of each of said N column beamformers;

wherein said M/2 phase shifting networks are each configured to implement a phase slope across its respective ports; and wherein each of said M/2 phase shifting networks implements a phase slope that slopes to approximately 180 degrees.

18. An antenna as claimed in claim 17 wherein:

said antenna elements are positioned in a triangular grid pattern;

said M/2 phase shifting networks are row phase shifting networks;

said antenna additionally comprises N/2 additional column phase shifting networks each of which has M ports, wherein said M ports of said N/2 column phase shifting networks couple to respective ones of said M beam ports from N/2 of said column beamformers;

said N/2 column phase shifting networks are each configured to implement a phase slope across its respective phase shifting network ports; and each of said N/2 column phase shifting networks implements a phase slope that slopes to approximately 180 degrees.

* * * * *